US008650718B2

(12) United States Patent
Isik

(10) Patent No.: US 8,650,718 B2
(45) Date of Patent: Feb. 18, 2014

(54) IN YARN PRODUCTION, APRON CLADDING MECHANISM AND METHOD TO THE ROLLERS COATED WITH ELASTIC MATERIAL AND FOUND IN THE DRAFTING AND GUIDING ZONE, HAVING SHIFT STRUCTURE AND PRE-TENSIONING MECHANISM

(75) Inventor: Namik Kemal Isik, Bursa (TR)

(73) Assignee: Ozdilek ev Tekstil Sanayi ve Ticaret Anonim Sirketi, Bursa (TR)

( * ) Notice: Subject to any disclaimer, the term of this patent is extended or adjusted under 35 U.S.C. 154(b) by 0 days.

(21) Appl. No.: 13/260,761

(22) PCT Filed: Mar. 31, 2010

(86) PCT No.: PCT/TR2010/000062

§ 371 (c)(1),
(2), (4) Date: Dec. 19, 2011

(87) PCT Pub. No.: WO2010/114503

PCT Pub. Date: Oct. 7, 2010

(65) Prior Publication Data

US 2012/0096681 A1 Apr. 26, 2012

(30) Foreign Application Priority Data

Mar. 31, 2009 (TR) ..... 2009 02504
May 26, 2009 (TR) ..... 2009 04101

(51) Int. Cl.
*D01H 5/86* (2006.01)

(52) U.S. Cl.
USPC ..... 19/248; 19/249

(58) Field of Classification Search
USPC ..... 57/315; 19/244, 248, 249, 250, 251
See application file for complete search history.

(56) References Cited

U.S. PATENT DOCUMENTS 2,756,462 A * 7/1956 Hopkinson et al. ..... 19/249
2,794,214 A * 6/1957 Sandelin ..... 19/248
2,911,685 A * 11/1959 MacDonald ..... 19/251
2,926,393 A * 3/1960 Gardella ..... 19/250
4,067,088 A * 1/1978 Wurmli ..... 19/253

(Continued)

FOREIGN PATENT DOCUMENTS

WO 2005038104 A1 4/2005
WO 2010016808 A1 2/2010

OTHER PUBLICATIONS

International Search Report for the corresponding WIPO application PCT/TR2010/000062.

*Primary Examiner* — Shaun R Hurley
(74) *Attorney, Agent, or Firm* — Egbert Law Offices, PLLC

(57) ABSTRACT

The purpose of the invention is to reduce the abrasive impact of the fiber or the yarn on the rollers coated with elastic material, which are used for drafting and guiding purposes in yarn production techniques, and thus keep the operating conditions and yarn quality parameters constant. The fiber on the top rollers coated with elastic material especially in the mechanical ring compact yarn production among the yarn production techniques, is an apron cladding method, over the top roller and the bearing guide arms connected to a bearing body found on the bearing unit placed on the pressure arm, in a way that it would cover these together. The method includes the operation steps of stretching the aprons by application of tension via a tension component and, while the fiber drafting operation continues, the bearing unit carrying the aprons being shifted in the horizontal plane in certain intervals.

19 Claims, 16 Drawing Sheets

(56) References Cited

U.S. PATENT DOCUMENTS

| | | | | |
|---|---|---|---|---|
| 4,513,481 | A * | 4/1985 | Suzuki et al. | 19/244 |
| 6,112,509 | A * | 9/2000 | Artzt et al. | 57/315 |
| 6,341,484 | B2 * | 1/2002 | Dinkelmann et al. | 57/315 |
| 7,475,531 | B2 * | 1/2009 | Artzt et al. | 57/315 |
| 8,099,835 | B2 * | 1/2012 | Artzt et al. | 19/244 |
| 2007/0169459 | A1 * | 7/2007 | Artzt et al. | 57/315 |
| 2009/0144942 | A1 * | 6/2009 | Artzt et al. | 19/286 |

* cited by examiner

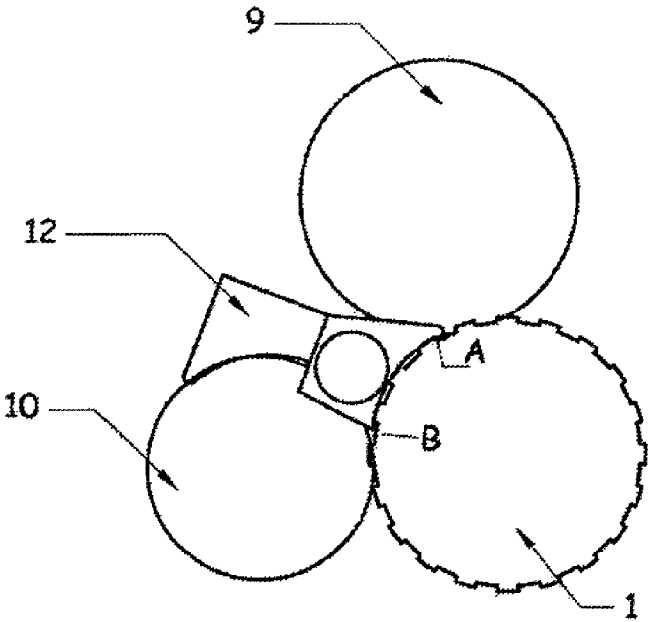
Figure 2
PRIOR ART
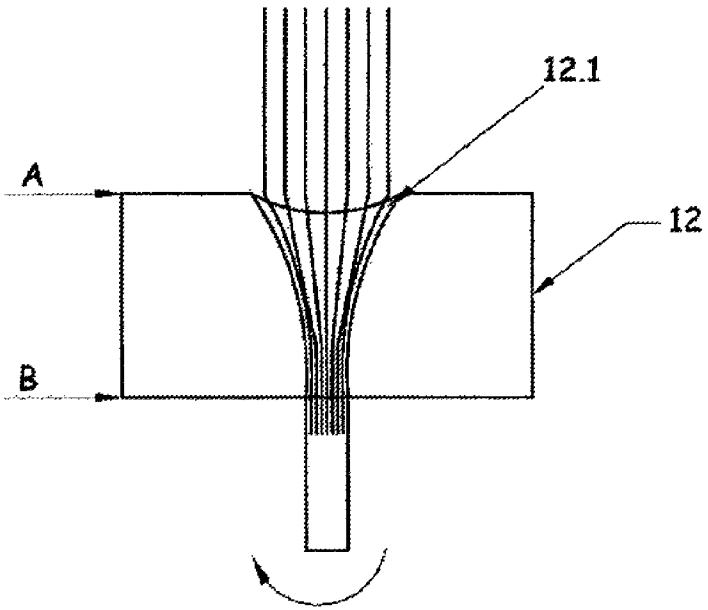
A-B Detail

IN YARN PRODUCTION, APRON CLADDING MECHANISM AND METHOD TO THE ROLLERS COATED WITH ELASTIC MATERIAL AND FOUND IN THE DRAFTING AND GUIDING ZONE, HAVING SHIFT STRUCTURE AND PRE-TENSIONING MECHANISM

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The invention relates to the improvement provided to the rollers which are coated with elastic material, found in the drafting and guiding zone, and used in yarn production techniques, by apron cladding having shift structure and pre-tensioning mechanism.

2. Description of Related Art Including Information Disclosed Under 37 CFR 1.97 and 37 CFR 1.98

Nowadays, in almost all of the yarn production techniques, rollers coated with elastic material are used either for drafting purposes or with the purpose of guiding the yarn to the next stage. The yarn, according to the place it is used either in fibre form or in its final form, contacts these rollers with a certain tension and it is exposed to drafting or guiding process via these rollers.

Material hardness of the rollers coated with elastic material is directly related with the quality of the yarn produced and its function, and the elastic material hardness of the top rollers at the drafting zone is especially important for the quality of the yarn.

It is a known situation that the contact of the fibre or the yarn with the roller coated with elastic material has an abrasive effect. As the application point allows, the machine producers move the fibre or the yarn on the rollers on which they are guided or drafted in order to delay the abrasion of the elastic material and extend its operation period.

Compact ring yarn spinning technique is an important example in which the abrasion in the rollers coated with elastic material is intensive. In the compact spinning technology, yarns are positioned closer to each other by using a compacting zone just after the main drafting zone, and thus the spinning triangle is almost removed. In this way, the improvement of the properties of the yarn, for example increasing its strength, and reducing its hairiness is aimed.

One of the compact ring yarn production techniques is the mechanical compactor mechanism. In FIGS. 1 and 2, the views of the prior mechanical compactor mechanism is given and the operating principle of this mechanism will be explained below by making references to the reference numbers found in the figures. In FIG. 1, the side schematic view of the mechanical compactor mechanism used in the prior art for producing compact yarn is given. In FIG. 2, the detail view showing the positions of the mechanical compactor and the rollers relative to each other is given. As it is seen in the figures, a Delivery drafting roller (1) initiated by the gearbox, supports the Top roller (9) and the Front roller (10) belonging to the compaction zone. The contact point of the compaction zone is between the points A and B shown in FIG. 2. The mechanical compactor (12), which is a precision instrument, presses on the Delivery drafting roller (1) without any gaps. The mechanical compactor (12) forms a completely closed compaction room together with the Delivery drafting roller (1), and the Delivery drafting roller (1) surface moves together with the fibres synchronously in order to guide these fibres to the compactor (12) precisely. As it is seen in the detail view of the A-B compaction part, a compaction channel (12.1) is found at the inner part of the mechanical compactor (12), which has a funnel shaped structure narrowing downwardly. The fibres entering through the Delivery drafting roller (1) and the Top roller (9) are compacted while they go downwards through the compaction channel (12.1) which is found at the inner part of the mechanical compactor (12). When the compacted fibres go out of the channel (12.1), they are exposed to winding operation by passing through the Front roller (10) and the Delivery drafting roller (1) and they become high durability yarn.

As it is seen in FIG. 1, mechanical compact yarn production mechanism according to the prior art comprises a Delivery drafting roller (1), which is made of metal based material and which makes rotational motion by being initiated by the gearbox and a Middle drafting roller (2), a roving guide (11) which operates as a guide for providing entrance of large numbers of fibre into the mechanism, a bottom apron (8) which is placed over a Middle drafting roller (2) and the Bottom apron guide bar (6), and a Top apron (7) which is placed over the Top apron roller (5) and the Apron cradle (4). Fibres entering from the roving guide (11) are compacted by passing through the top and the bottom apron (7,8). Fibres passing through the top and the bottom apron (7,8) reach between the Delivery drafting roller (1) and the Top roller (9). Via a pressure arm (3) of the mechanism, the Top roller (9) made of rubber material is pressed onto the Delivery drafting roller (1) with a certain force. The drafted and expanded fibres which passed through the Delivery drafting roller (1) and the Top roller (9) are guided to the mechanical compactor (12). Since the fibres pass through almost at the same place, abrasions occur at the rubber Top roller (9) surface and these deformations increase when the operation hours extend. Due to the deformations on the rubber surface, problems occur such as frequent grinding or renewal labour for the Top roller (9), loss of production, and quality differences between spindles. Yarn end brakes per average of 1000 spindles increase with the deformations at the surface, and problems occur due to the abundance of quality error cleaning in winding, which is the next operation, and therefore the expenses of maintenance increase. Moreover, in the prior mechanism, the fibres (20) which cannot enter the compactor (12) during spinning (FIG. 6A) generate fluffs, and these fluffs causes environment and machine pollution and/or it is added to the yarn structure at the spinning zone in an uncontrolled way. This situation makes negative impact on the yarn quality and operation conditions. Since the position of the clearer roller (18) shown in FIG. 6A is distant from the fibres (20) that can not enter the compactor, it is not effective in accumulating fibres on itself.

About the mechanical compact yarn production mechanism, the application with publication number WO 2006005207 is found as the closest document to the mechanism, which is the subject of the invention. However, when this patent document is examined, it can be seen that adequate solution suggestions are not provided in this document for eliminating the above said drawbacks and problems.

As a result, the inadequacy of the prior solutions have necessitated an improvement on the related field, which reduces the abrasion tendency at the rollers coated with elastic material for drafting and guiding purposes in the yarn production techniques, eliminates the said drawbacks and disadvantages in the mechanical ring compact spinning which is especially the basis of operation, improves the yarn parameters, and provides more efficient operation conditions.

3. Disadvantages of the Prior Art:

In the known status of the art, the abrasive impact on the elastic material and the coated surface as a result of the contact between the rollers coated with elastic material and the fibre or the yarn is inevitable after a certain period. Guiding of the fibre or the yarn to the rollers coated with elastic material by continuous moving, use of elastic material developed with different formulas, and choosing the roller dimensions in the smallest diameters and widths that can be used according to the application point are the applications for delaying this abrasion impact.

Despite all these measures, in the spinning techniques in which the fibre or the yarn is guided to the roller coated with elastic material without moving to the left or to the right or with a very little moving distance;

1. Maintenance labours due to abrasion in very short periods
2. Quality problems due to rapid abrasion
3. Great quality deviations between production units, and
4. Negative operating conditions due to abrasion originating impacts such as breaks, laps etc. are observed.

Since the fibres pass through almost at the same place also in the prior mechanical compact ring spinning system, they rapidly cause abrasion at the place that they pass through on the Top roller (9). As a result of this, deformations occur in the yarn quality parameters and operating conditions. In order to prevent such an undesired condition, the Top roller (9) has to be grinded and renewed in very short periods. After each grinding, diameter of the Top roller (9) decreases and due to the decreased rubber amount, the hardness impact of the Top roller (9) increases. This situation ruins the fibre expanding property between the Top roller (9) and Delivery drafting roller (1).

Ineffective Removal of the Fluffs Occurring at the Compactor Zone:

In FIG. 6*a*, fibres (20) that cannot go through the compactor (12) during the spinning operation in the present system are shown. Perspective view given in FIG. 6*b* shows the distance of the clearer roller (18) to the fibres (20) coming out in between the top roller (9) and compactor (12) in the prior art. This distance is not sufficient for clearer roller (18) to collect the fibres (20) that cannot go through the compactor on itself.

The fibres (20) that can not enter the compactors generate fluffs, and these fluffs causes environment and machine pollution and/or it is added to the yarn structure at the spinning zone in an uncontrolled manner. This situation makes negative impact on the yarn quality and operation conditions.

BRIEF SUMMARY OF THE INVENTION

Purpose of the Invention

The main purpose of the invention is to develop a mechanical compact ring yarn production mechanism which eliminates the deficiencies found in the present mechanical compact yarn mechanism, improves the yarn parameters, and provides more efficient operating conditions.

The purpose of the invention is to provide application of a band called apron on the roller, in order to decrease the short term fibre or yarn originating abrasion impact on the roller made of material coated with elastic material, and comprise techniques which would extend the abrasion period.

In the mechanical compact yarn production mechanism, which is the subject of the invention, the technique of operating apron on the roller is used.

Patent applications are found which disclose various apron applications used in yarn production systems. The patents with publication numbers EP 0635590, WO2005038104 and WO2007101742 can be given as examples to these applications. However, in the invention, the improvements such as:

1. Formation of the apron applied on the roller larger than the perimeter of the roller such that it would be as large as the other equipments allow, and thus the abrasion period can be extended,
2. Obtaining different fibre or yarn path by shifting the apron on the roller by choosing the apron to be used in a narrow size than the roller width, and thus the abrasion period can be extended,
3. Uniform winding of the apron to be used on the roller via a stretching mechanism mounted on the roller bearing component, are provided. In this way, advantages are obtained which can not be provided with the prior apron coating patents on the roller.

Again with the invention;

- Winding of the apron over the roller coated with elastic material by stretching the apron via a stretching system,
- Formation of the apron with large perimeter as large as the space and mechanics at the application point allow (large operation surface, abrasion delay),
- Formation of the apron in a way that it is narrower than the roller coated with elastic material in order to be able to move the apron to the left or to the right on the roller coated with elastic material,
- Obtaining new yarn or fibre contact path by moving the apron to the left or to the right on the roller coated with elastic material (extension of the period of usage),
- Providing the operation of shifting the apron to the left or to the right on the roller coated with elastic material be made manually or automatically even during the progress of the production via the systems which will be developed according to the place of application,
- Formation of a bearing unit according to the present mechanics in order to provide the apron be mounted to its place of application,
- Formation of guide arms on this bearing unit, which will guide the apron in order to keep the apron on the roller coated with elastic material,
- In order to be able to coat the apron on the roller coated with elastic material with a certain tension, formation of a tension system between the bearing unit and the present mechanics (spiral or leaf spring, rubber chock etc), are provided.

With the application of narrow Top roller apron (17) and soft Top roller (9) under it, the pressure on the fibre is increased, and thus more effective fibre control is provided. Extension of the abrasion period due to the apron (17) used in the application being made of a material which is highly durable against abrasion regarding the present Top roller (9) and having less abrasion because of its structure, and also the perimeter of the apron (17) being larger than the present Top roller (9), is the most significant factor in reducing the yarn breaks. Application of narrow Top roller apron (17) and the effective point of the clearer roller (18) have also provided improvement in the next operations.

As a result of the above said benefits of the narrow Top roller apron (17), the defective zones determined in winding have decreased (especially A1 zone in Classimat). Moreover, it has provided the advantages of reducing maintenance expenses, which are very important for business, reducing laps and yarn end breaks per hour, thus reducing the workload.

In order to achieve the above said purposes, the invention is a method, which comprises the phases of tensioning of the aprons (17) by application of tension via a tension component (22) and shifting of the bearing unit (15) carrying the aprons (17) in predetermined intervals while the fibre drafting operation continues in order to decrease the abrasion impacts on the said apron (17) caused just before the winding operation for production of compact yarns by the fibres moving over the aprons (17), which are covered over the bearing guide arms (15.2) connected to a bearing body (15.1) on a bearing unit (15) placed on the pressure arm (3) and the Top rollers (9) in a way that it would cover these (9, 15.2) together, and thus since the Top roller (9) and apron (17) surfaces are abraded in a longer period, the usage and operation periods are extended.

Again the invention is a fibre drafting mechanism, in which just before the winding operation for the production of compact yarn, the aprons (17), which are covered over the bearing guide arms (15.2) connected to a bearing body (15.1) on a bearing unit (15) placed on the pressure arm (3) and the Top rollers (9) and can be shifted in horizontal plane if desired, in a way that it would cover these (9, 15.2) together, and which are stretched by application of a tension.

The structural and characteristic features of the invention and all advantages will be understood better in detailed descriptions with the figures given below and with reference to the figures, and therefore, the assessment should be made taking into account the said figures and detailed explanations.

BRIEF DESCRIPTION OF THE DRAWINGS

FIG. 2 is the detail view showing the positions of the mechanical compactor and the rollers relative to each other.

REFERENCE NUMBERS

Figure 1:
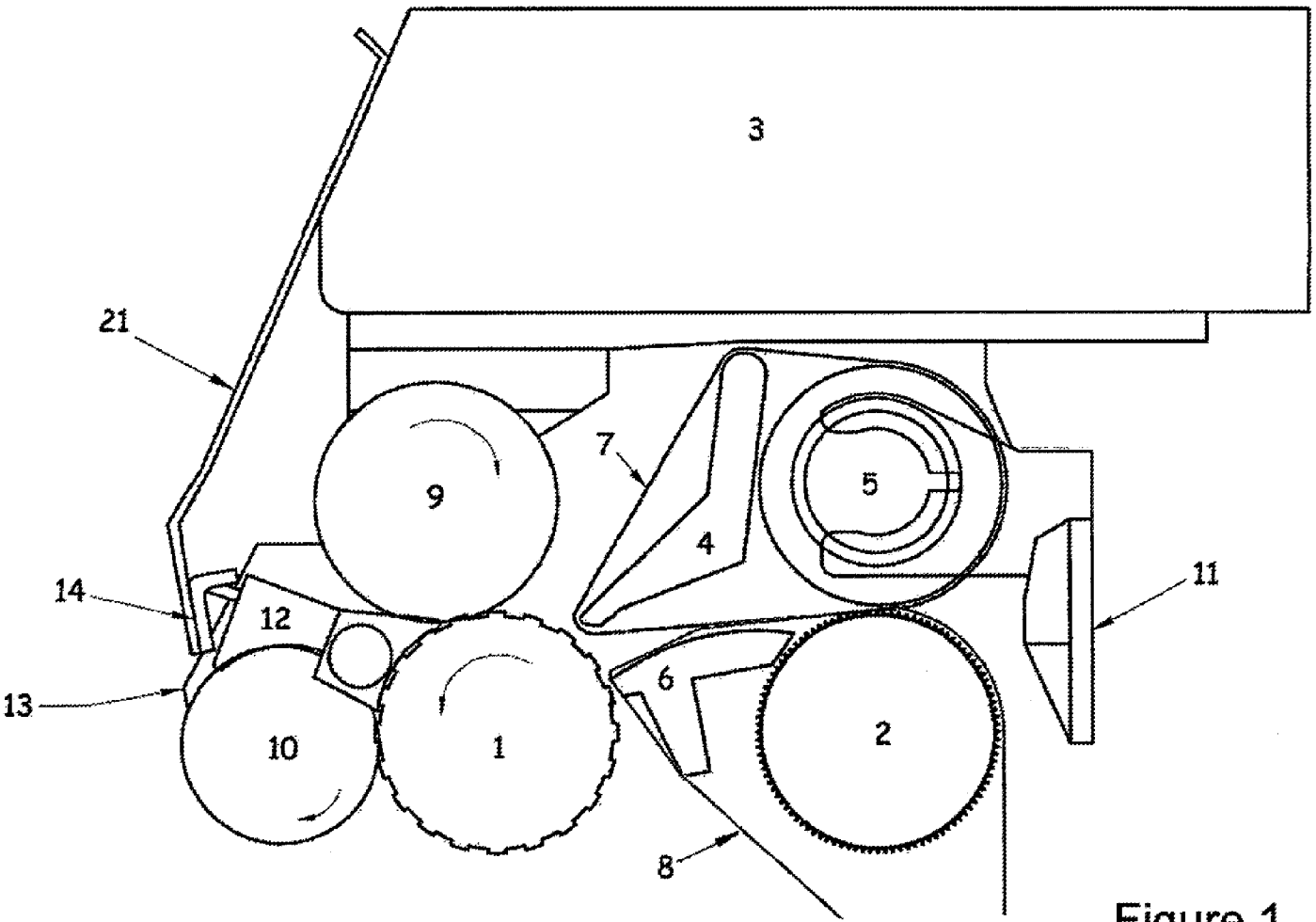
Figure 1 PRIOR ART
FIG. 1 is the side schematic view of the mechanical compactor mechanism used in the prior art for producing compact yarn.

1. Delivery drafting roller
2. Middle drafting roller
3. Pressure arm
4. Apron cradle
5. Top apron roller
6. Bottom apron guide bar
7. Top apron
8. Bottom apron
9. Top roller
10. Front roller
11. Roving guide
12. Mechanical compactor
12.1 Compaction channel
13. Front roller cage
14. Compactor centralizer
15 Bearing unit
15.1 Bearing body
15.2 Guide arms

15.2.1 Roller bearing
15.2.2 Limiter
15.2.3 1st grade cavity
15.2.4 2nd grade cavity
15.3 Housing
15.4 Bar housing
15.5 Additional roller bearings
15.6 Housing base
16. Clearer roller bearing component
17. Top roller apron
18. Clearer roller
19 Fixing component
19.1 Adjustment component
19.2 Pressure adjustment pin
19.3 Retaining ring
20. Fibre that can not enter the compactor
21. Front roller pressure spring
22 Tension component
23 Shift components

DETAILED DESCRIPTION OF THE INVENTION

The invention relates to a mechanical compactor fibre yarn production mechanism used in producing compact yarn.

In the yarn production techniques, the rollers coated with elastic material are commonly used at the points where the fibre or the yarn are drafted or at the parts where they are guided to the next step. As examples for the yarn spinning systems, ring spinning, rotor spinning, air jet spinning systems etc. can be given. In all these spinning techniques, the roller coated with elastic material systems with drafting or guiding purposes are used.

In mechanical compact ring spinning yarn production, the required explanations are made regarding the operation of the mechanism and the deficiencies of the known status of the art. In such yarn spinning systems, for modelling the elimination of the deficiencies of the known status of the art, a study is made on the Top roller (9) coated with elastic material in the mechanical compact ring spinning system and the details of this study are given below.

If the subjects which are the basis of the invention are considered under main headings;

Improvement Obtained by Application of Apron (17) Over the Top Roller (9):

The deformations in the yarn quality parameters and the operating conditions by rapid abrasion of the Top roller (9) in the prior art have been disclosed in the above technical part. In the improvement made, an apron (17) is placed on the Top roller (9), which is in narrower dimensions than the Top roller (9), but which is made of a material having higher abrasion resistance and which has larger perimeter than the Top roller (9). This apron (17) is stretched via a bearing unit (15) mounted on the pressure arm (3) and a bearing body (15.1) which is connected to this unit (15), and thus its movement together with the Top roller (9) over the Delivery drafting roller (1) is provided.

By choosing the Top roller (9) as soft as possible and by choosing the apron (17) as narrow as possible than the Top roller (9), a higher pressure is applied on the fibre with the present pressure force. In this case, better fibre control and thus improvement in the yarn quality parameters are obtained. The apron (17) materials being resistant against abrasion and its perimeter being larger than the Top roller (9), long-lasting usage with constant values are provided. The perimeter of the apron (17) being larger than the perimeter of the Top roller (9) is the factor which also increases its expected life.

Figure 3A:
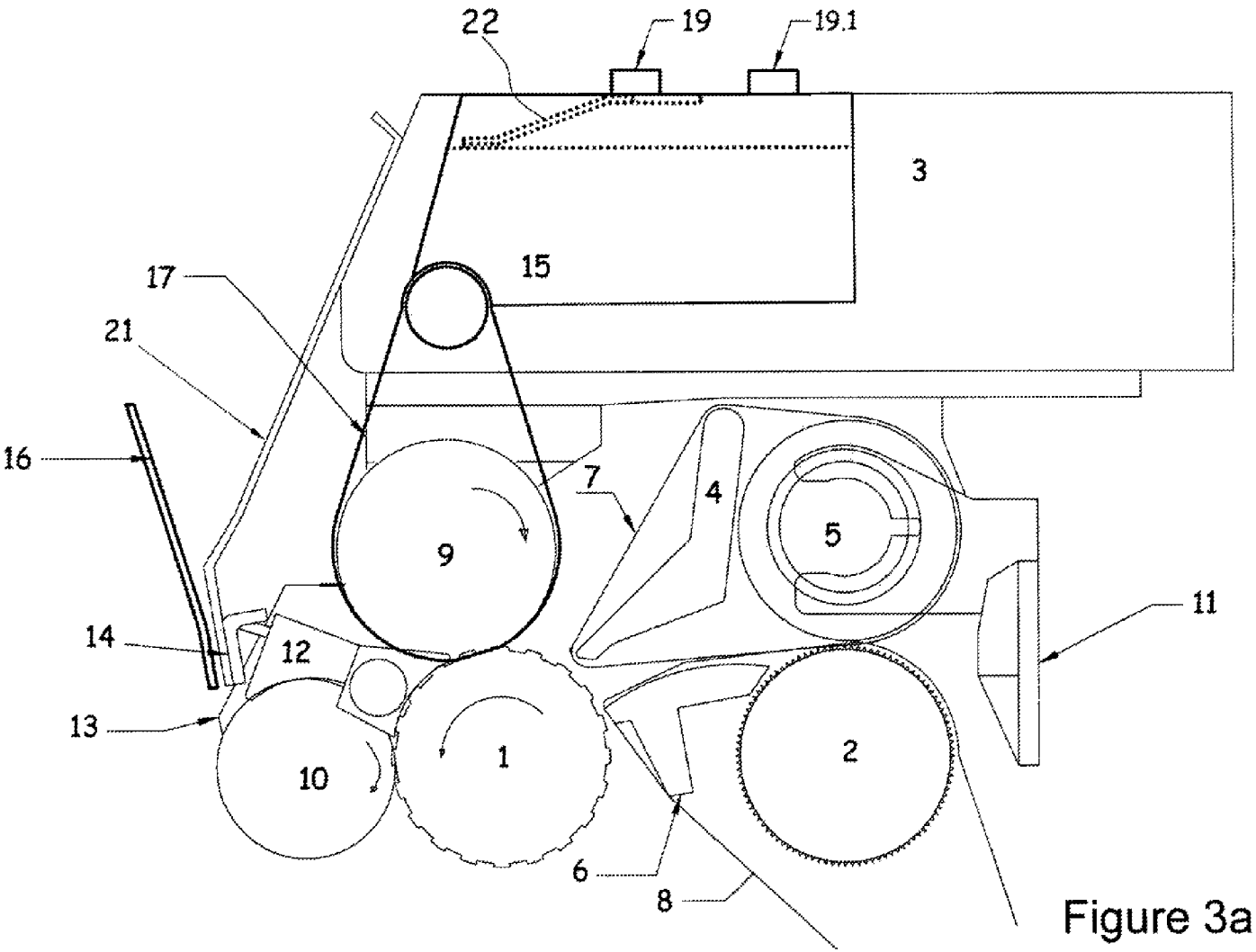
FIG. 3*a* is the side schematic view of the alternative mechanical compactor mechanism, which is the subject of the invention.
Figure 3B:
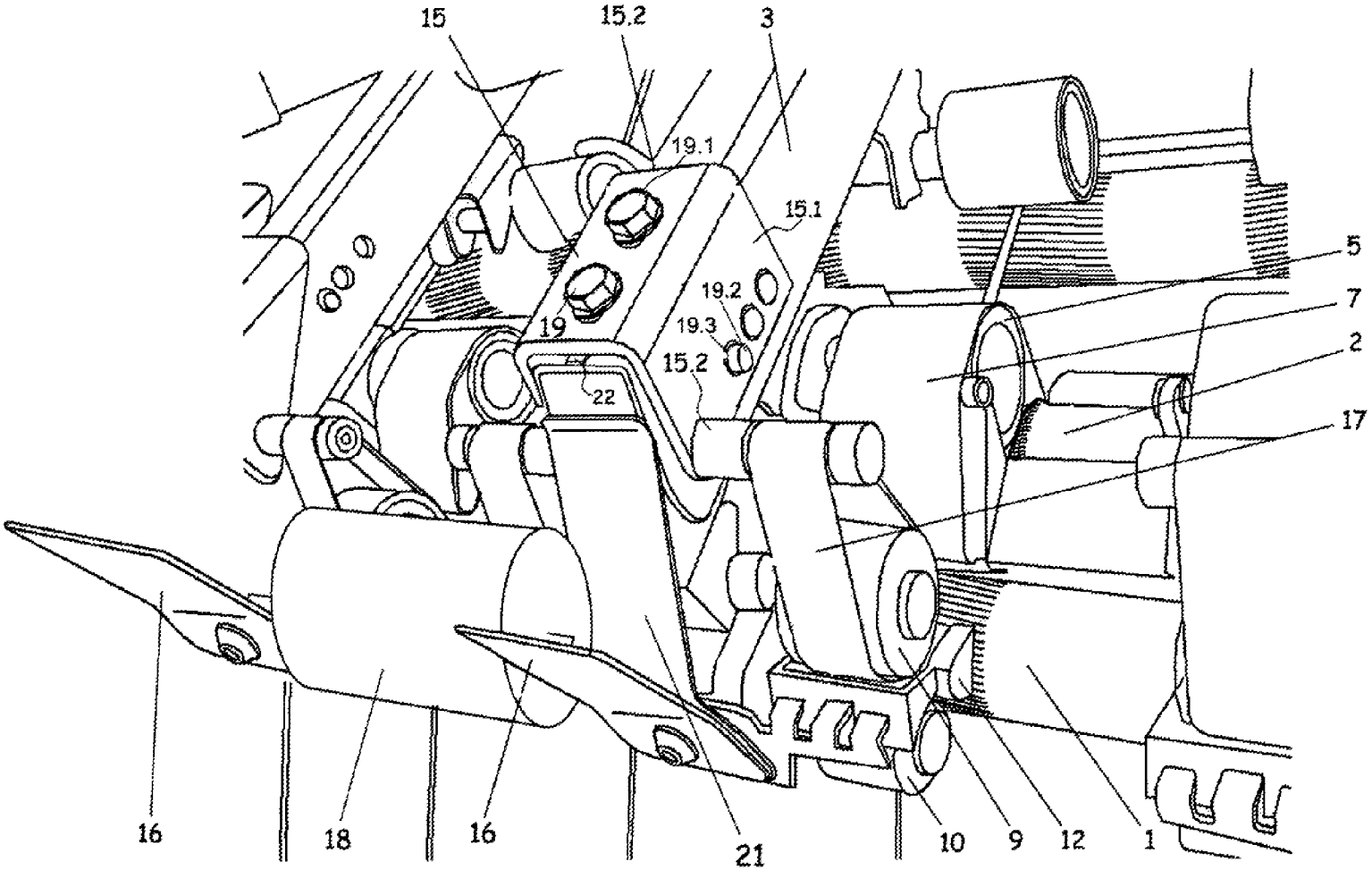
FIG. 3*b* is the perspective view of and alternative embodiment of the invention.

In FIG. 3*a*, the side schematic view of the mechanical compactor mechanism, which is the subject of the invention, and in FIG. 3*b* the perspective view of the mechanical compactor mechanism, which is the subject of the invention are given. Mechanical compactor yarn production mechanism; comprises a Delivery drafting roller (1), which is made of metal based material and which makes rotational motion by being initiated by the gearbox and a Middle drafting roller (2), a roving guide (11) which operates as a guide for providing entrance of large numbers of fibre into the mechanism, a bottom apron (8) which is placed over a Middle drafting roller (2) and the Bottom apron guide bar (6), and a Top apron (7) which is placed over the Top apron roller (5) and the Apron cradle (4). Fibres entering from the roving guide (11) are compacted by passing through the top and the bottom apron (7,8). Fibres passing through the top and the bottom apron (7,8) are compacted by passing through the Delivery drafting roller (1) and the Top roller (9) and through the compaction channel (12.1) (See FIG. 2 A-B detail) at the inner part of the mechanical compactor (12), and finally they are made into yarns after the winding operation made at the outlet of the Front roller (10) and the Delivery drafting roller (1), and they are wound on the bobbins found on spindles.

Via a pressure arm (3) of the mechanical compactor mechanism, the Top roller (9) made of rubber material is pressed on the Delivery drafting roller (1) with a certain force. The fibres passing through the Delivery drafting roller (1) and the Top roller (9) are expanded and guided to the mechanical compactor (12).

As it is seen in FIG. 2, a Delivery drafting roller (1) initiated by the gearbox belonging to the mechanical compact yarn production mechanism, supports the Top roller (9) and the Front roller (10) belonging to the compaction zone. The contact point of the compaction zone is from the point A to point B. The mechanical compactor (12), which is a precision instrument, presses on the Delivery drafting roller (1) without any gaps. The mechanical compactor (12) forms a completely closed compaction room together with the Delivery drafting roller (1), and the Delivery drafting roller (1) surface moves together with the fibres synchronously in order to guide these fibres to the compactor (12) precisely. As it is seen in the detail view of the A-B compaction part, a compaction channel (12.1) is found at the inner part of the mechanical compactor (12), which has a funnel shaped structure narrowing downwardly. The fibres entering through the Delivery drafting roller (1) and the Top roller (9) are compacted while they proceed downwards through the compaction channel (12.1) which is found at the inner part of the mechanical compactor (12) and when the compacted fibres come out of the channel (12.1), they are exposed to winding operation by passing through the Front roller (10) and the Delivery drafting roller (1) and they become high durability yarn.

However, since the fibres pass through almost at the same place between the Delivery drafting roller (1) and the Top roller (9), abrasions occur in a short while at the rubber Top roller (9) surface. The Top rollers (9) grinded after short periods of usage are removed and grinded or they are replaced with a new Top roller (9). In both situations, very high labour force losses and additional processing (grinding etc.) and material costs occur.

As it is also said above, in order to prevent the abrasion formed on the Top roller (9) made of rubber material, different from the mechanical compact yarn mechanisms of the prior art, apron (17) application is made on the Top roller (9). The Top roller apron (17) operates on the Top roller (9) on which the abrasions occur and guides the fibres to the mechanical compactor (12). Moreover, since the width of the apron (17) used is narrower than the Top roller (9) width the force impact formed on the fibre by the pressure arm (3) increases and thus better fibre control is provided. With the application of narrow Top roller apron (17) and soft Top roller (9) under it, the pressure on the fibre is increased, and thus more effective fibre control is provided. Extension of the abrasion period due to the apron (17) used in the application being made of a material which is highly durable against abrasion regarding the present Top roller (9) and having less abrasion because of its structure, and also the perimeter of the apron (17) being larger than the present Top roller (9) provided extending the abrasion period. This situation is one of the most significant factors in reducing the yarn breaks.

In FIGS. 2 and 3*a*, the exit drafting zone in the ring spinning system is given as side view. The fibres guided from the rear part are drafted through the Top roller (9) coated with elastic material mounted on the pressure arm (3) and the Delivery drafting roller (1) found below it, and they are guided to the spinning system at the outlet of the rollers (1,9).

During guidance of the fibres, the Top roller (9) coated with elastic material is abraded with time. On the Top roller (9) coated with elastic material on which abrasion occurs, it is essential to clad an apron (17) under tension in a narrower dimension and larger diameter than the Top roller (9) coated with elastic material, which would be shifted to the left or to the right when required. In order to provide bearing of the apron (17), a bearing unit (15) is mounted on the pressure arm (3). The guide arms (15.2) fitted on the bearing unit (15) is used in order to provide the bearing of the apron (17) to be able to rotate with the initiation of the Delivery drafting roller (1) on the Top roller (9) coated with elastic material.

Figure 5C:
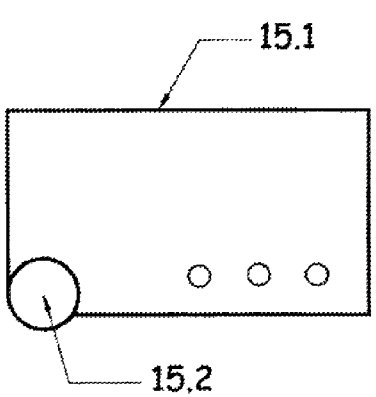
FIG. 5*c* is the side view of the bearing body according to the alternative embodiment.
Figure 5A:
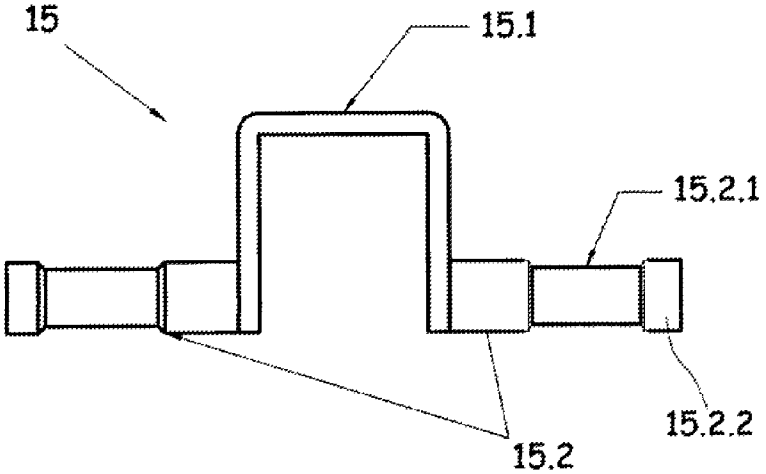
FIG. 5*a* is the front view of the bearing body according to the alternative embodiment.
Figure 5B:
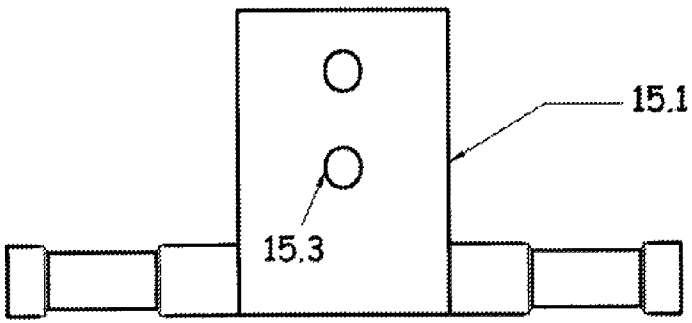
FIG. 5*b* is the upper view of the bearing body according to the alternative embodiment.

In FIGS. 5*a*, 5*b* and 5*c*, a bearing body (15.1) belonging to the said alternative embodiment is shown. As it is seen in FIG. 5, the bearing unit (15) mounted on the pressure arm (3); comprises a bearing body (15.1) having a convenient cavity with the form of the pressure arm (3) in a way that the pressure arm (3) would be mounted on it, preferably two guide arms (15.2) formed integrally at the side parts of the bearing body (15.1), and roller bearings (15.2.1) formed on the guide arms (15.2) in order to provide the apron (17) fully fit. The roller bearings (15.2.1) allow the apron (17) make rotating motion together with the Top roller (9) on the guide arms (15.2) without shifting to the left or to the right. As an alternative to the guide arms (15.2) having fixed structure, the pulleys and couplings having rotating structure which allow rotating motion of the apron (17) can also be used as the bearing component.

In FIG. 3*b*, the perspective view of and alternative embodiment of the invention is given. According to the figure, the Top roller apron (17) makes rotational motion in a way that, on one hand while it is in contact with the Top roller (9) surface, on the other hand it is in contact with the roller bearing (15.2.1) surface formed on the guide arms (15.2) belonging to the bearing body (15.1) mounted on the pressure arm (3).

Again as it is clearly seen in FIG. 5*a*, 5*b*, 5*c*, a housing is formed at the upper surface of the bearing body (15.1). The bearing body (15.1) is mounted on the pressure arm (3) via a fixing component (19) passing through the housing (15.3). By providing mounting of the bearing unit (15) and the bearing body (15.1) on the pressure arm (3) via the housing (15.3), the distance setting between the guide arm (15.2) and the Top roller (9) and therefore the tension of the apron (17) can be adjusted.

In order to provide bearing of the apron (17), a bearing unit (15) is mounted on the pressure arm (3). The guide arms (15.2) fitted on the bearing unit (15) is used in order to provide the apron (17) with the bearing that it would rotate on the Top roller (9) coated with elastic material with the initiation of the Delivery drafting roller (1). The tension component (22) between the pressure arm (3) and the bearing unit (15) provides the apron (17) to be wound over the Top roller (9) coated with elastic material with a certain tension. Tension component (22) can be formed in various different forms, such as leaf spring, spiral spring, bending chock etc.

Figure 8A:
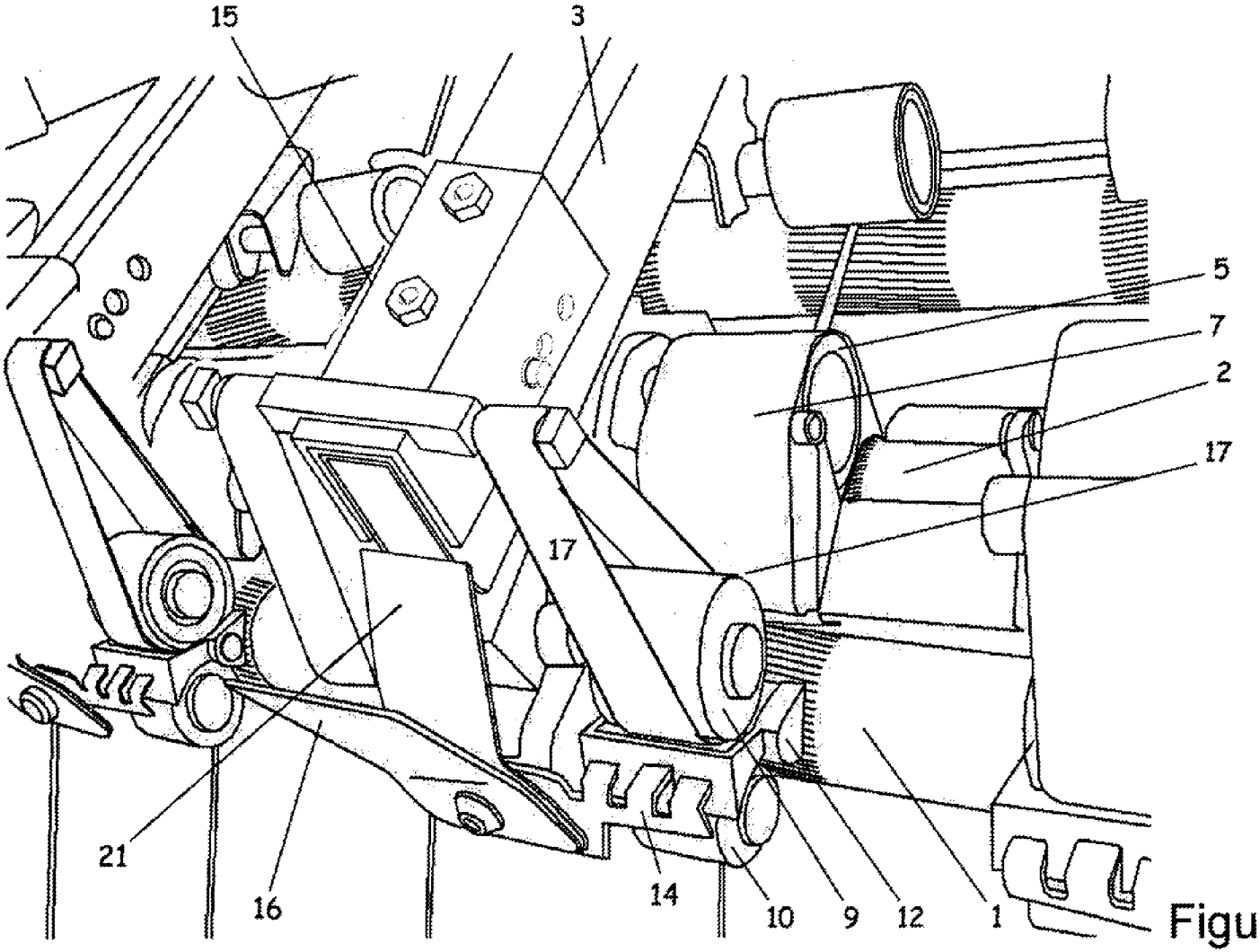
FIG. 8*a* is the perspective mounted view of the bearing unit in the shift mechanical compact mechanism, which is the subject of the invention.

Again as it is seen in FIG. 3*a*, 3*b* (alternative) and in FIG. 8*a*, the tension adjustment of the bearing unit (15) and the bearing body (15.1) pushed upwards via a tension component (22) is provided with the help of a fixing component (19), which preferably a screw. Moreover, in order to make distance adjustment between the said bearing unit (15) and the bearing body (15.1) and the pressure arm (3), an adjustment component (19.1) is placed on the bearing body (15.1). In the said placement operation, the adjustment component (19.1) is fixed on the pressure arm (3) found below in a vertical form, from the hole/housing opened on the bearing body (15.1). The adjustment component (19.1) is preferably in a screw form and it keeps the bearing unit (15) and the bearing body (15.1) and the pressure arm (3) in a certain distance if adjustment is not made. At the same time, it also limits the tension component. This component (19.1), by being rotated to the left or right, provides an adjustment operation by increasing or decreasing the distance between the bearing unit (15) and the bearing body (15.1) and the pressure arm (3).

Via the said tension component (22), rotation of the Top roller apron (17) is provided with a tension, or in other words, its free rotation is prevented. When a little pressure is applied from above on the said bearing unit (15) and the bearing body (15.1), the bearing unit (15) and the roller bearings (15.2.1) which are mounted together with the guide arms (15.2) integrally shown in FIG. 3*a*,3*b* (alternative) and FIG. 8*a*, move downwards and the Top roller aprons (17) can have a more free form.

Moreover, an adjustment component (19.1) is used between the said pressure arm (3) and the bearing unit (15) in order to determine the tension limit point. The fixing component (19) is used for fitting the tension component (22) to the bearing unit (15). Again, in order to provide the said bearing unit (15) be fit to the pressure arm (3) in a way that it would be able to move, pin (19.2) is used. The pin (19.2) connects the pressure arm (3) and the bearing unit (15) via retaining rings in a way that it would not prevent upwards and downwards motion of the bearing unit (15). In this way, the bearing unit (15) mounted on the pressure arm (3) via the pin (19.2) stretches the apron (17) rotating between the Top roller (9) coated with elastic material and the guide arms (15.2) as much as the adjustment component (19.1) allows via the tension component (22) fitted into its inner part.

In order to adjust the pressure distribution of the said Top rollers (9) the pin (19.2) is placed on the pressure arm (3). While the structural function of the said pin (19.2) remains same, bearing of the pin (19.2) is provided by addition of retaining rings (19.3) to the bearing body (15.1). Mounting of the tension component (22) to the bearing body (15.1) is provided via the fixing component (19) and the holes which are projections of the housings (15.3) formed on the bearing body (15.1). While the said tension component (22) is mounted on the bearing unit (15) and the bearing body (15.1) to be adjusted by the fixing component (19), it is also in contact with the pressure arm (3) in order to bend and make pressure on the pressure arm (3). In this way, a bend between the pressure arm (3) and the bearing unit (15) and the bearing body (15.1) is provided. Therefore, with this bend provided by the pressure arm (3), a tension load is provided on the guide arms (15.2) connected to the bearing body (15.1) seen in the FIG. 3*a*, 3*b* (alternative) and the FIG. 8*a*, and the aprons (17) in bearing position on the roller bearings (15.2.1).

In the said invention; the guide arms (15.2) can be fitted on the guide arm (bar) housing (15.4) on the bearing unit (15) via the grade cavities (15.2.3, 15.2.4) in a way that it is shifted to the left or right. As an alternative to this embodiment, the guide arms (15.2) can be mounted to the pressure arm (3) as a screw. Guide arms (15.2) can be shifted to the left or right on the pressure arm (3) with a screw motion.

In both embodiments or in all shifting techniques which can be alternative, the purpose is to provide the guide arms (15.2) be shiftable to the right or left on the bearing unit (15). Thus, the apron (17) which is narrower than the width of the Top roller (9) coated with elastic material can be shifted on the Top roller (9) coated with elastic material. The purpose is to obtain a new operating surface on the apron (17), which is not abraded by the fibre or yarn coming from the systems at the backside. Thanks to this operation, the expected life of the apron (17) increases twice or more.

Figure 7:
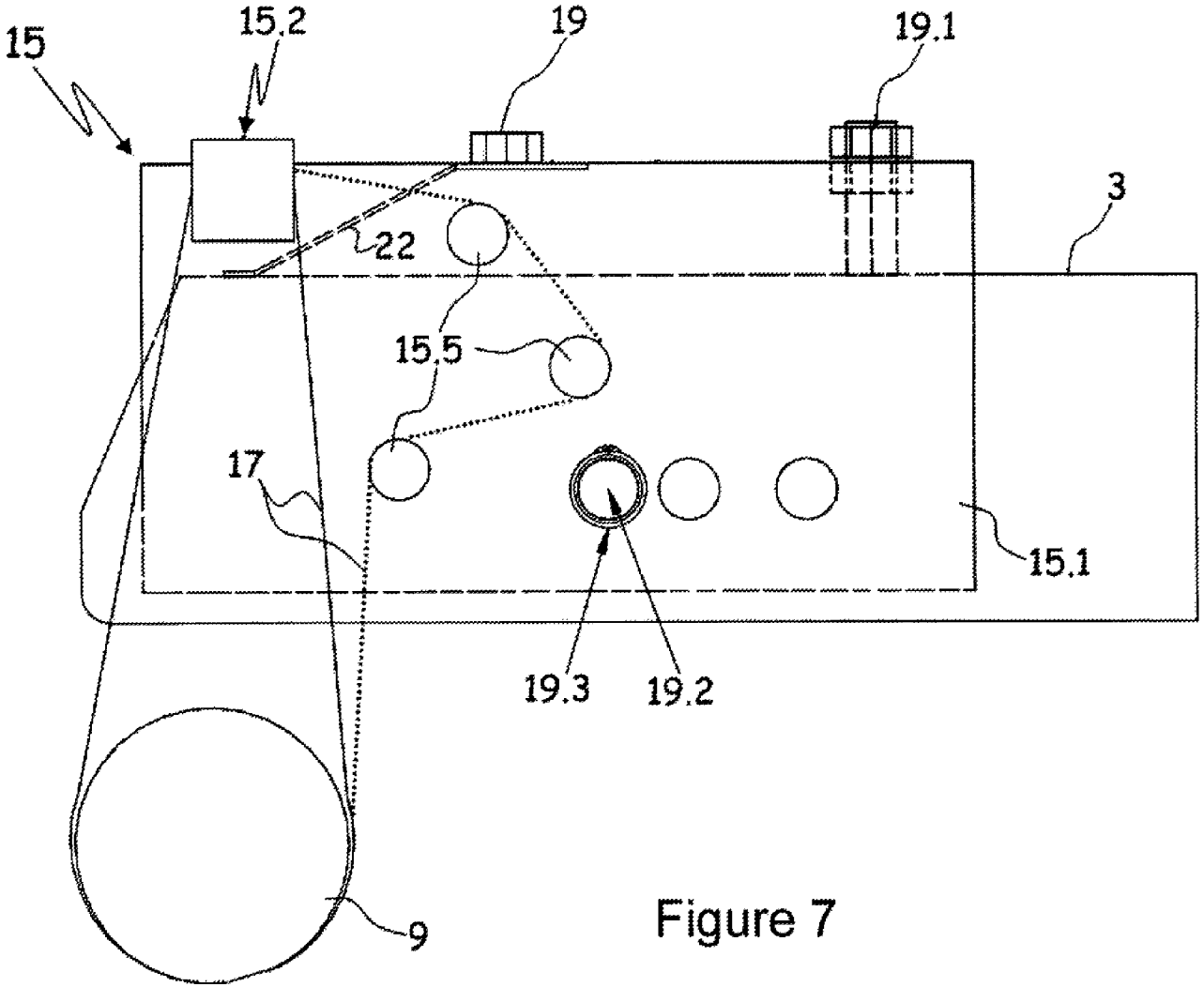
FIG. 7 is the side mounted view of the bearing unit found in the mechanical compact mechanism, which is the subject of the invention.

In FIG. 7, the side mounted view of the mechanical compactor mechanism, which is the subject of the invention is given. According to the figure, the bearing unit (15) and the bearing body (15.1) are seen which are placed on the said pressure arm (3) in contact with each other via the tension component (22) and the adjustment component (19.1). At the front part of the bearing unit (15), a guide arm (15.2) is placed. The said guide arm (15.2) is in a modular structure and it provides bearing of the apron (17). The apron (17) seen in the figure can have a longer perimeter through the guide arms (15.2) which would be added on the bearing unit (15). This can be made until the most available apron (17) perimeter is obtained at all places that the application will be made. The purpose is to obtain the largest apron (17) perimeter which can be applied according to the perimeter of the perimeter of the Top roller (9) coated with elastic material, and thus extend the abrasion period said in the known status of the art.

Figure 9A:
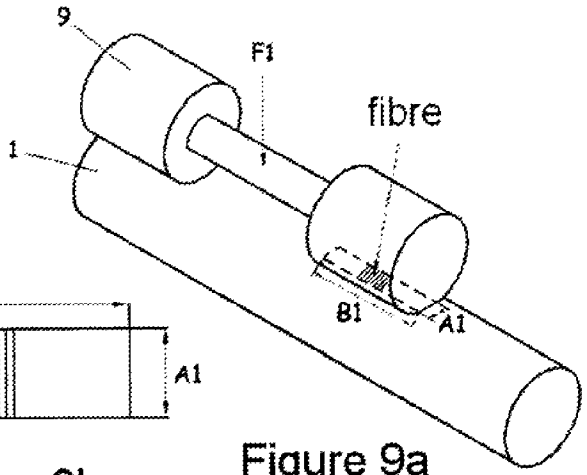
FIG. 9*a* is the perspective view showing the contact between the Top roller and the Delivery drafting roller in the prior art.
Figure 10A:
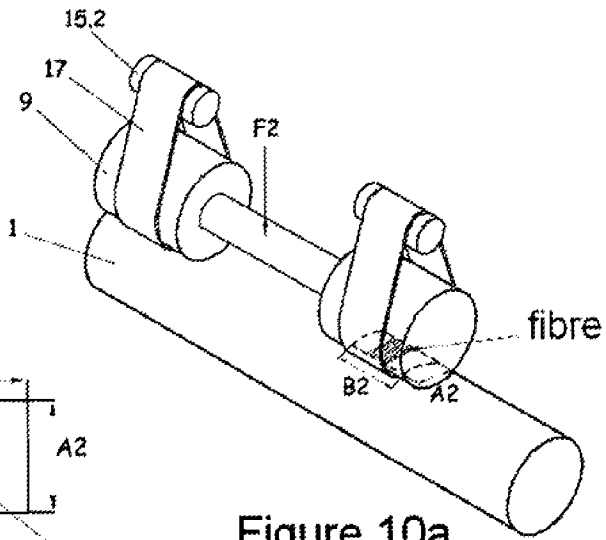
FIG. 10*a* is the perspective view showing the contact between the Top roller apron and the Delivery drafting roller, which is the subject of the invention.

In FIG. 9*a*, the perspective view showing the contact between the Top roller (9) and the Delivery drafting roller (1) in the prior art is given. In FIG. 10*a*, the perspective view showing the contact between the Top roller apron (17) and the Delivery drafting roller (1), which is the subject of the invention, is given. The width of the Top roller apron (17) used is preferably the half of the width of the Top roller (9) width.

Figure 9B:
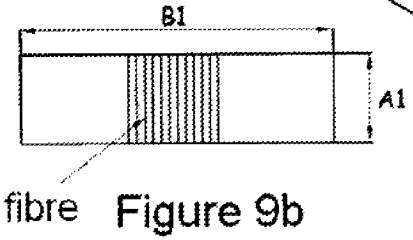
FIG. 9*b* is the schematic view showing the fibre pinch distance and the contact width between the Top roller and the Delivery drafting roller in the prior art.

In FIG. 9*b*, the fibre pinch distance (A1) and the contact width (B1) between the Top roller (9) and the Delivery drafting roller (1) in the prior art is given.

Figure 4B:
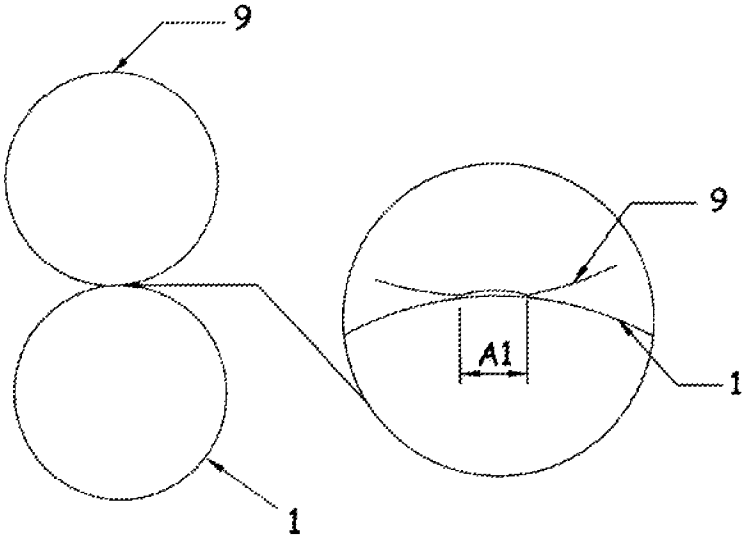
FIG. 4*b* is the detail view showing the crush of the Top roller in the mechanical compact mechanism of the prior art.
Figure 4A:
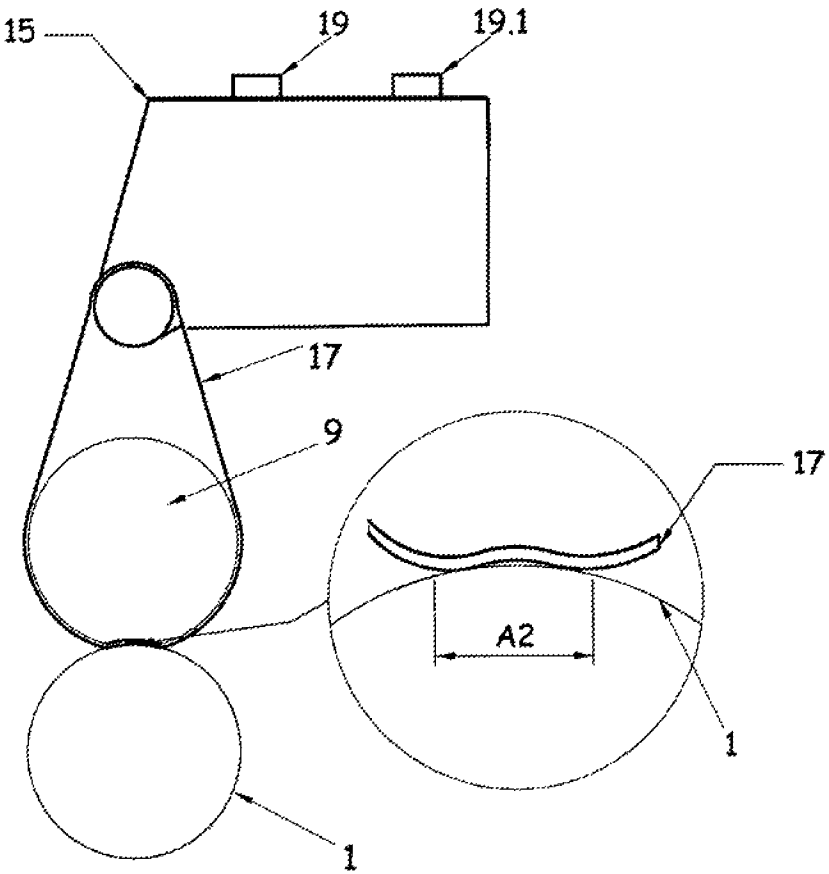
FIG. 4*a* is the detail view showing the crush of the Top roller in the mechanical compact mechanism of an alternative embodiment of the invention.
Figure 10B:
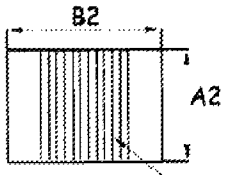
FIG. 10*b* is the schematic view showing the fibre pinch distance and the contact width between the Top roller and the Delivery drafting roller, which is the subject of the invention.
Figure 11A:
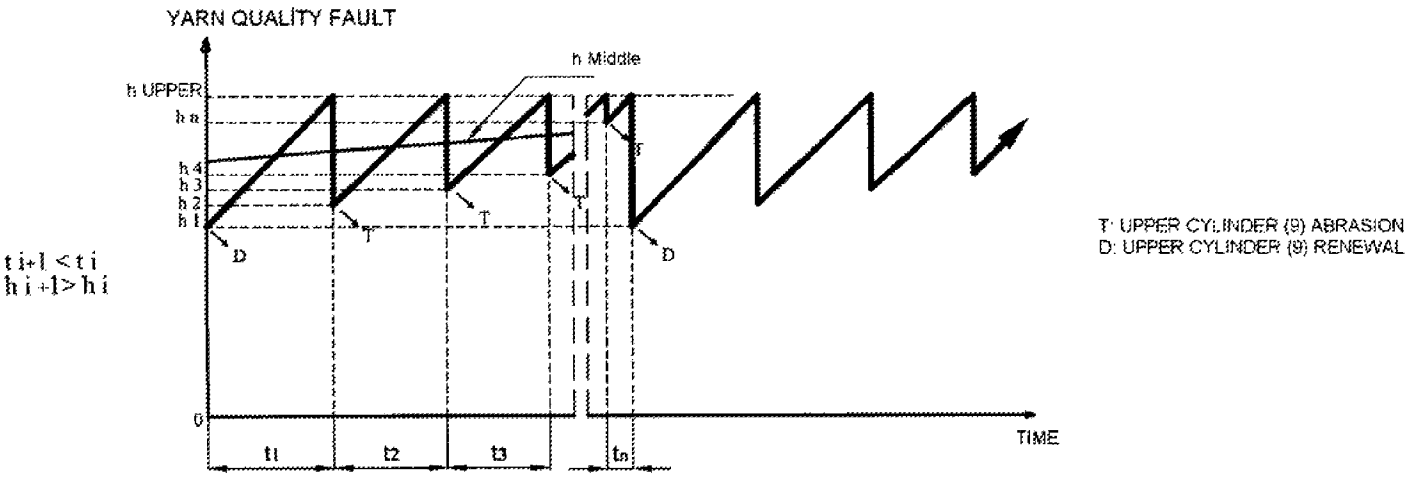
FIG. 11*a* is the yarn quality error versus time graph according to the prior art.
Figure 11B:
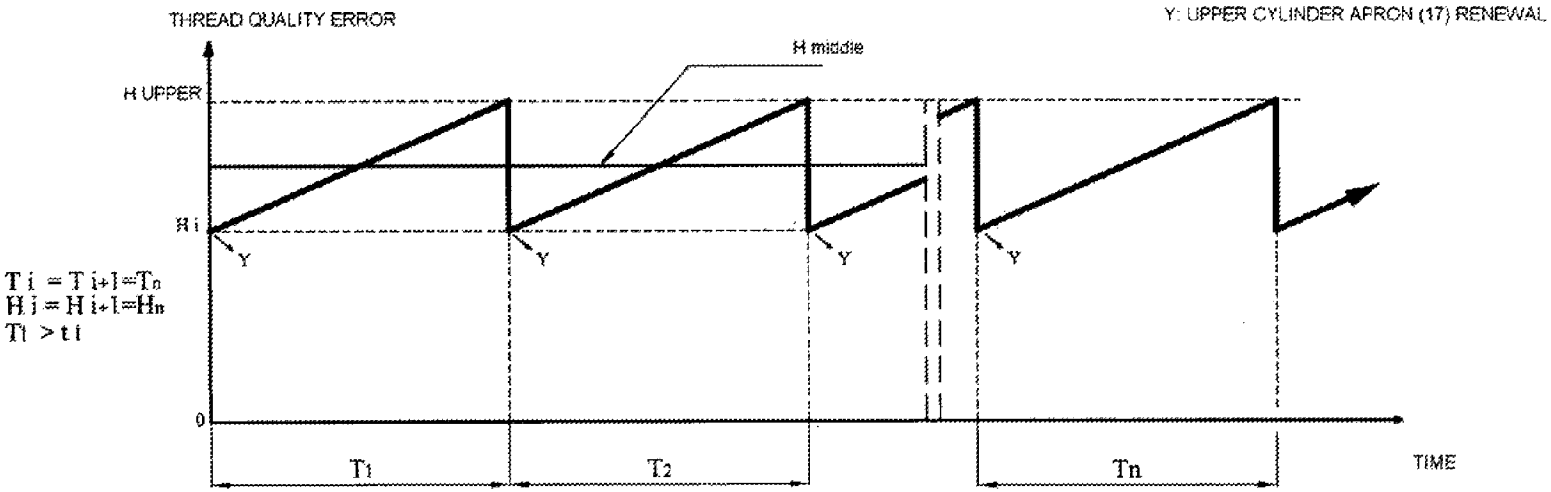
FIG. 11*b* is the yarn quality error versus time graph after the application according to the subject of the invention.

In FIG. 10*b*, the fibre pinch distance (A2) and the contact width (B2) between the Top roller apron (17) and the Delivery drafting roller (1), which is the subject of the invention, is given. A1 and A2 pinch distances are given in the side views in the FIGS. 4*a* and 4*b*.

As it is again seen in FIG. 7, while the said apron (17) can be wound only between the Top roller (9) and the guide arms (15.2), it can also make ring over the additional roller bearings (15.5) which are formed on the bearing unit (15) and/or the bearing body (15.1).

Figure 8B:
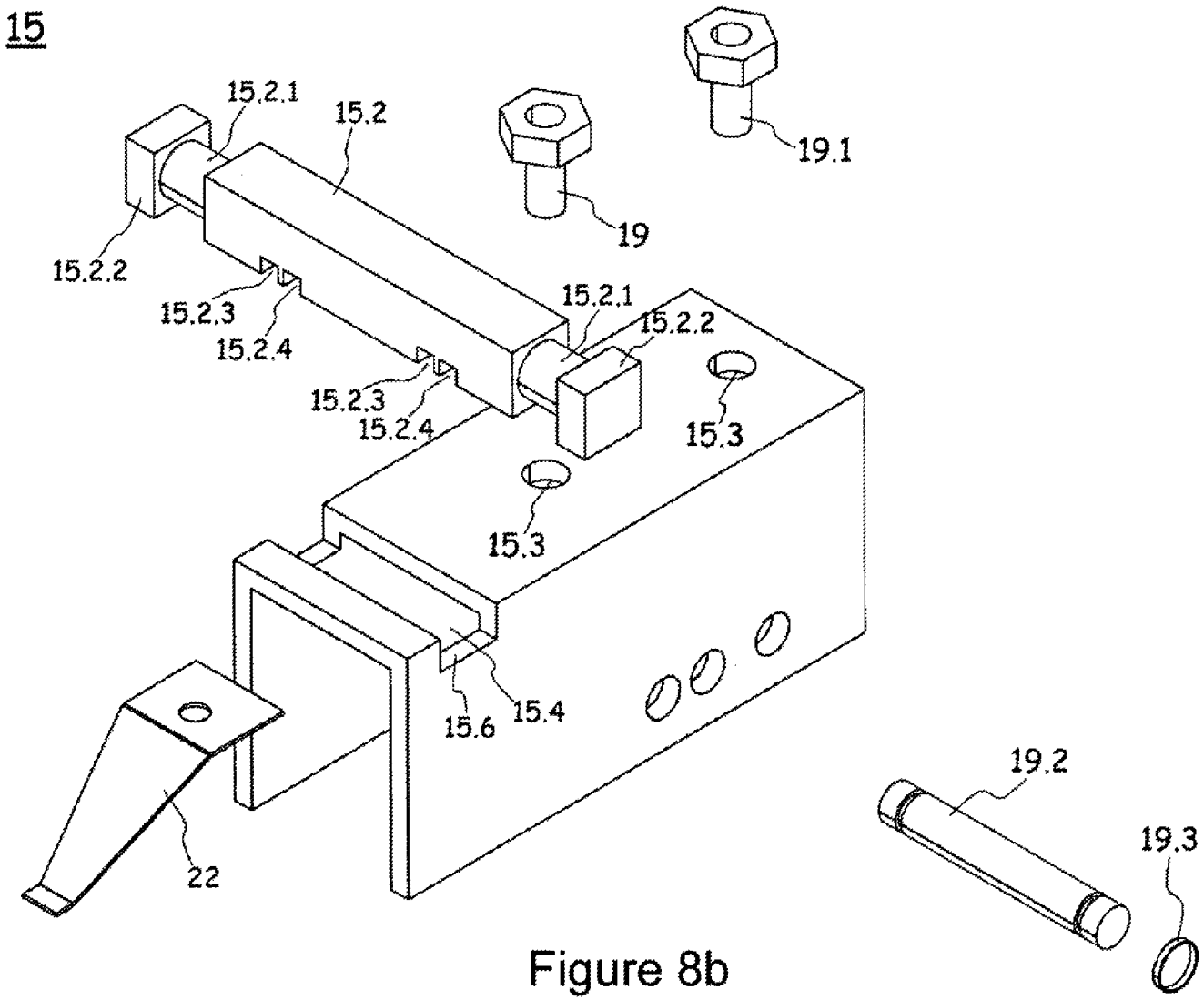
FIG. 8*b* is the demounted perspective view of the bearing unit in the mechanical compact mechanism, which is the subject of the invention.

In FIG. 8*a*, the mounted perspective view of the bearing unit (15) in the mechanical compact mechanism, which is the subject of the invention, is given. As it is seen in the figure, the said guide arm (15.2) is placed at the lower part of the bearing body (15.1). At the lower part of the bearing unit (15), which has a demounted perspective view in FIG. 8*b*, a bar housing (15.4) is formed for placement of the said guide arm (15.2). Again as it is seen in FIG. 8*b*, grade cavities (15.2.3, 15.2.4) are formed at the lower part of the bar (23). Via these grade cavities (15.2.3, 15.2.4) the guide arm (15.2) can be fixed on the bar housing (15.4) by fitting on it. In the fitting operation the 1st grade cavities (15.2.3) or the 2nd grade cavities (15.2.4) are arbitrarily fitted on the housing base (15.6) in the bar housing (15.4).

For example, the guide arm (15.2), which is fitted on the 1st grade cavity (15.2.3) in the first usage, would form an abrasion zone by the yarn on the apron (17) which makes rings in a bearing form. After a certain time, when the abrasion increases, the said guide arm (15.2) is lifted upwards by being hold through the apron limiters (15.2.2) and thus it is removed from the bearing body (15.1). Afterwards, the guide arm (15.2) is shifted in the "−x axis" and the said guide arm (15.2) is again fixed on the bearing body (15.1) in a way that it would fit on the 2nd grade cavity (15.2.4) housing base (15.6) belonging to the guide arm (15.2). After this operation, the yarn will pass through another zone on the apron (17) which is not abraded. This operation is the method of usage of the un-abraded other surface of the apron (17), on which the used zone is abraded after usage. In this way, profitable usage of the apron (17) surface is provided. The adjustment operations said here are made without stopping the machine. This is a very important property. Because, stopping the machine for each adjustment operation causes serious losses in production. All the adjustments in the prior are made by stopping the machine. The known status of the art is exceeded by using the apron (17) in a profitable manner without stopping the production, and far exceeding the grinding or renewal life of the Top roller (9) used in the prior art.

As it is seen in the figures, via the Top roller apron (17), which is the subject of the invention, the contact width (B2) decreases and the fibre pinch distance (A2) increases regarding the prior art. Thanks to the increasing fibre pinch distance (A2), the fibres are caught better and their compaction is provided under higher pressure. In this way, control of fibre is provided in a much easier manner and the quality of the yarn increases.

For the mathematical explanation of the FIGS. 9*b* and 10*b*, the below given conditions have to be met:

a) F1=F2, b) The materials of the Top roller (9) in FIG. 9*a* and the Top roller (9) in FIG. 10*a* would have elastic properties and their hardness would be equal, c) The Top roller apron (17) width (B2) would be smaller than the prior Top roller (9) width (B1), In this case;

$$A2>A1$$

would be obtained. Since the F1 and F2 forces found in the figures have impact on a circular surface;

$$B1/B2>A2/A1$$

is obtained. In this case, the inequality could be expressed as;

$$A1\times B1>A2\times B2$$

According to these data the P1 pressure impacting on the fibres in the prior art in FIG. 9*a* is;

$$P1=(F1/2)/(A1\times B1)$$

Whereas, the P2 pressure impacting on the fibres in the mechanism, which is the subject of the invention is;

$$P2=(F2/2)/(A2\times B2)$$

According to the above given information, since F1=F2 and A1×B1>A2×B2;

$$P222\ P1$$

is obtained. In other words, under a constant F force, the pressure force applied on the fibre on a unit area is increased via the Top roller apron (17) used in the mechanism, which is the subject of the invention. In this way, the fibre is caught better, its control is provided in a better manner, and the quality of the yarn increases.

Effective Cleaning Obtained with the New Position of the Clearer Roller (18):

Since the clearer roller (18), with its new position, effectively catches the fibres (20) that cannot enter the mechanical compactor (12), and accumulates these on itself, their entrance into the yarn structure is prevented and the working environment is kept cleaner.

Figure 6B:
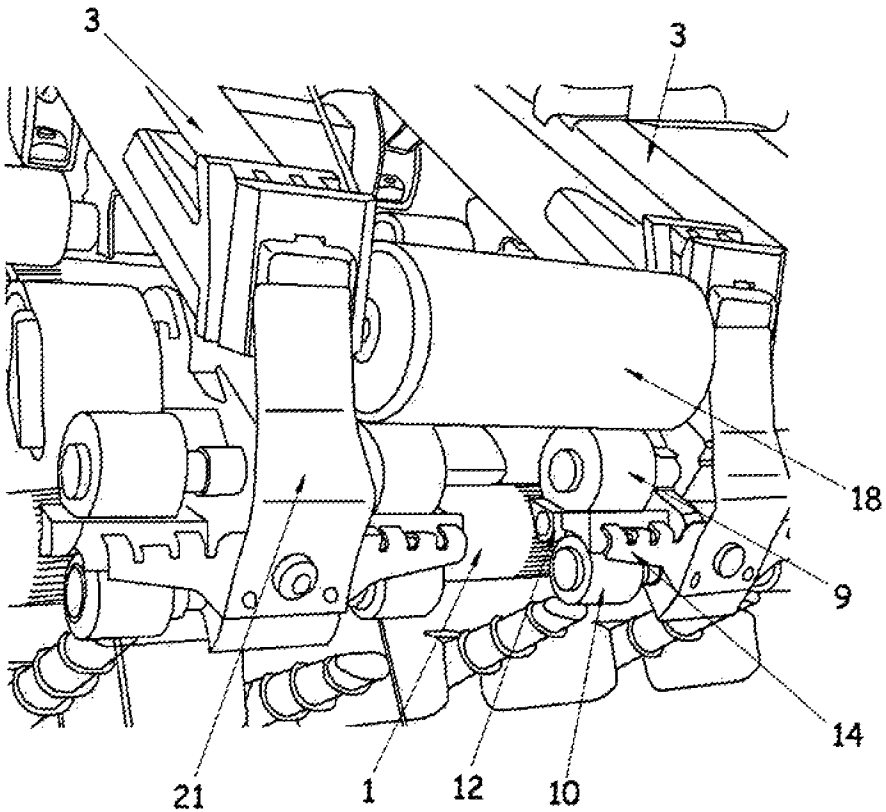
FIG. 6*b* is the perspective drawing showing the position of the clearer roller in the prior art.
Figure 6A:
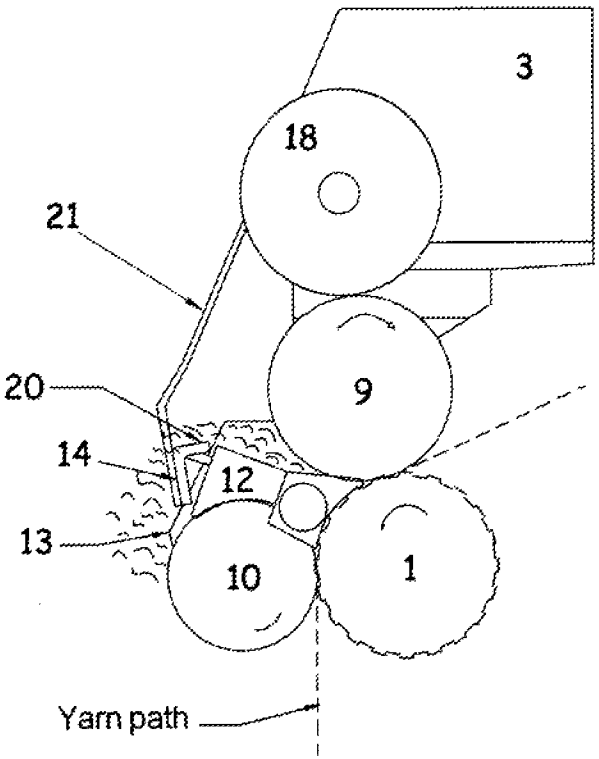
FIG. 6*a* is the representative drawing showing the positions of the fibres that do not enter the compactor and the clearer roller in the prior art.
Figure 6C:
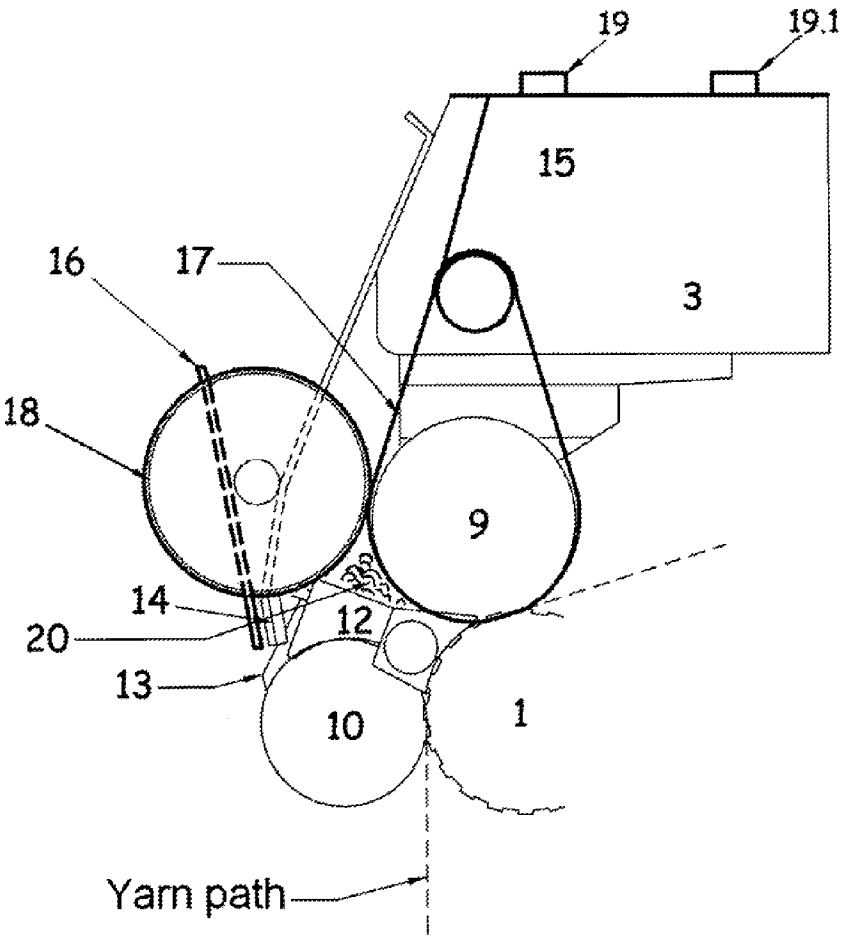
FIG. 6*c* is the representative drawing showing the layout of the clearer roller, which is the subject of the invention and effective removal of the fibres that do not enter the compactor from the environment via the clearer roller.

As it is seen in FIGS. 6*a* and 6*b*, in the prior art, the clearer roller (18) in cylindrical structure is far away from the zone where the fibres (20) that cannot enter the mechanical compactor (12) generate fluffs, its cleaning effect is quite small. As it is seen in FIGS. 5 and 6*c*, the clearer roller (18) is placed at a zone much nearer to these fibres generating fluffs via the clearer roller bearing component (16), which is the subject of the invention. In this way, the fluffs formed between the Top roller apron (17) and the mechanical compactor (12) is effectively taken onto the clearer roller (18). The clearer roller (18) is in contact with the Top roller apron (17) and makes rotating motion via the motion it takes from the apron (17), and thus gathers the fibre fluffs on itself and increases the yarn quality by preventing these fly be added into the yarn structure.

The length of the apron (17) used in FIG. 8*a* is longer than the one in FIG. 3*b*. In this way, the expected life of the apron (17) is longer. The said guide arm (15.2) seen in this structure can be gradually shifted to the right and to the left on the "x" plane. In this way, two different yarn paths can be obtained on the apron (17), which provides the increase of the expected of the apron (17) twice.

Whereas in FIG. 7, the length of the apron (17) is increased much more, which is used by forming additional roller bearings (15.5) on the said bearing body (15.1) (the apron (17) shown in dotted form in FIG. 7). In this way, the expected life of the apron (17) increased much more because of its increased length and also the guide arm (15.2) being gradually shiftable on the "x" plane.

Figure 8C:
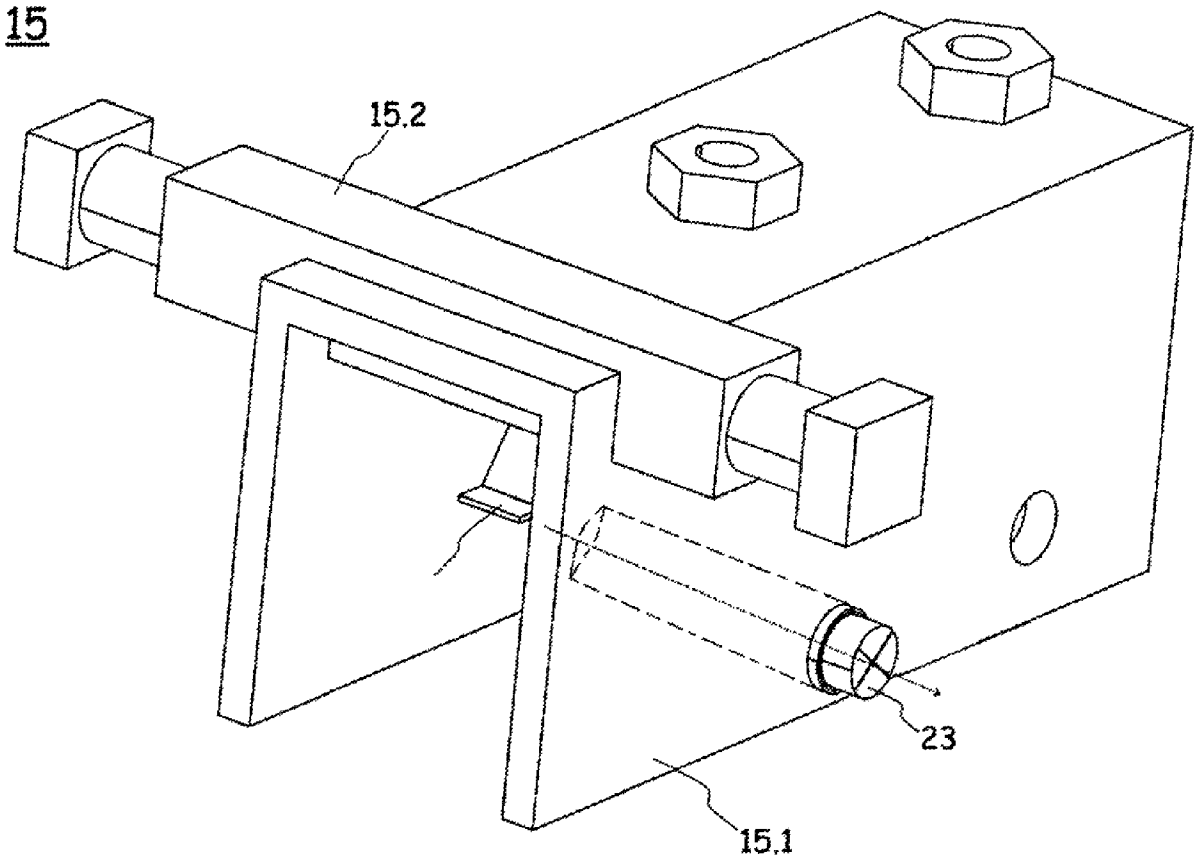
FIG. 8*c* is the view of an alternative embodiment of the bearing unit in the mechanical compact mechanism, which is the subject of the invention.
Figure 8D:
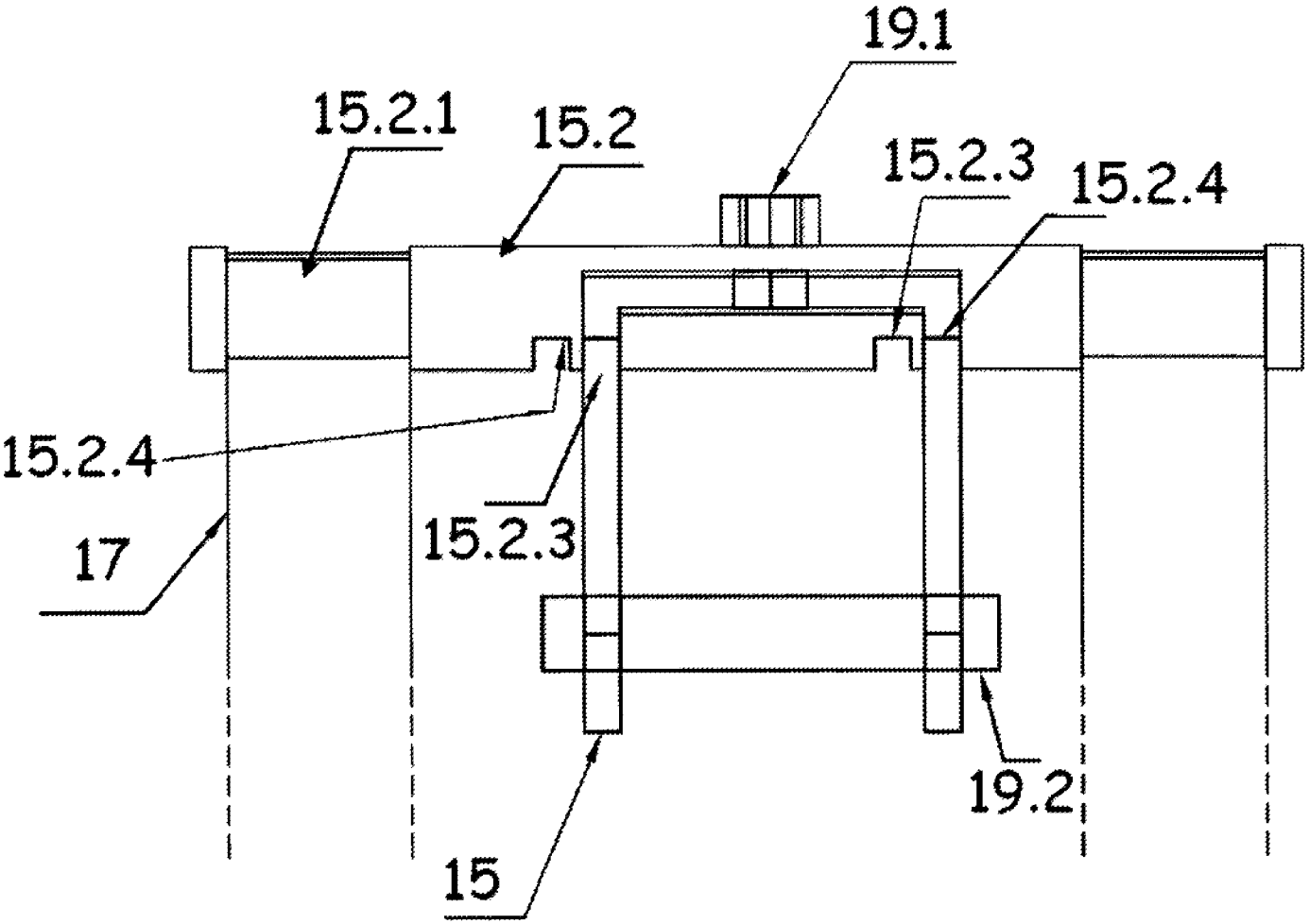
FIG. 8*d* is the front schematic view showing the application of the subject of the invention to the pressure arm and Front roller group of the ring spinning system.
Figure 8E:
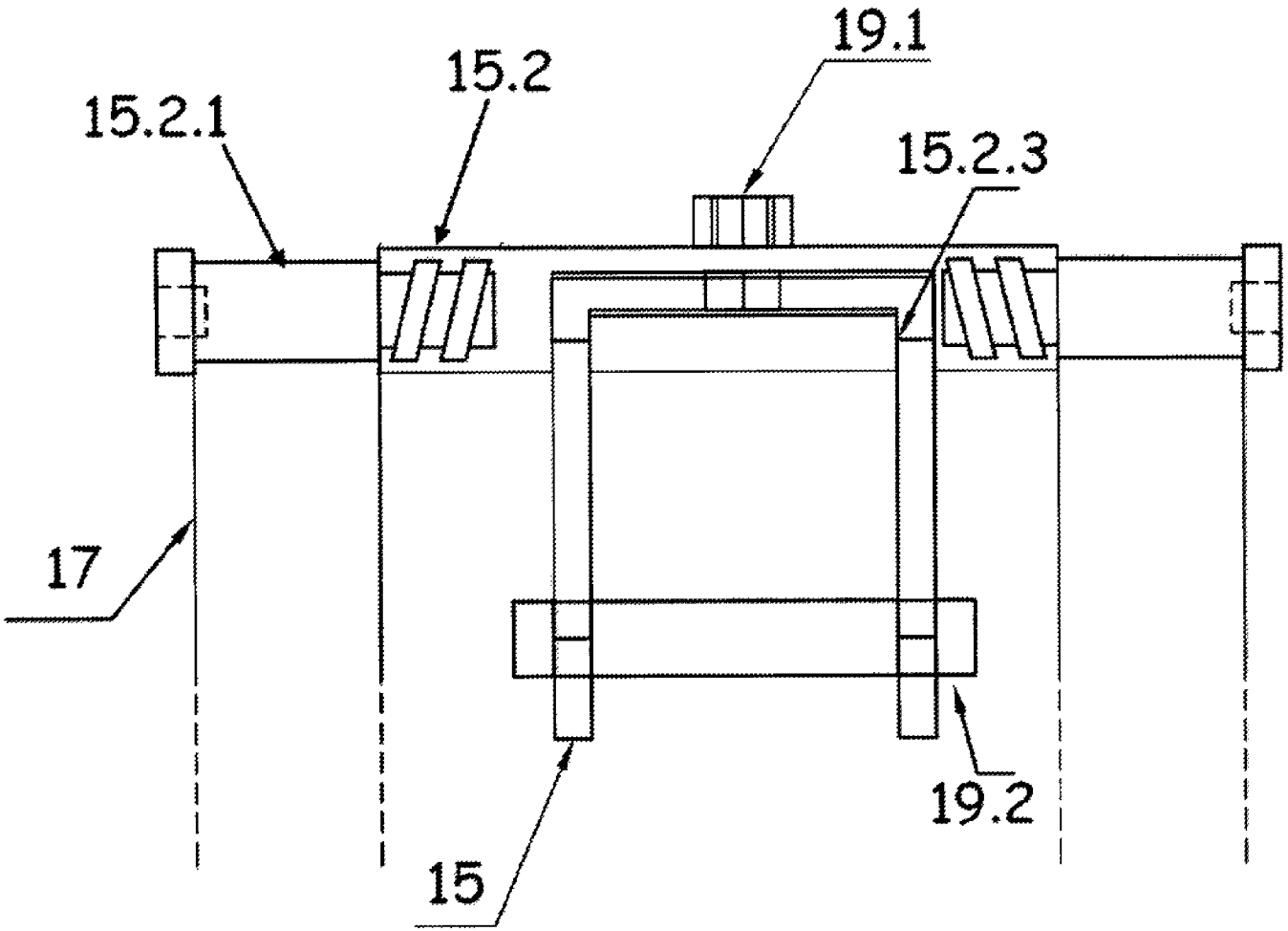
FIG. 8*e* is the front view of an alternative embodiment of the invention.

FIG. 8*c* is the view of another alternative embodiment of the bearing unit in the mechanical compact mechanism. For profitable use of the said apron (17), other alternative embodiments can also be formed in which the apron (17) is moved. In another alternative embodiment, the said guide arm (15.2) is again placed on the bearing body (15.1), whereas it makes its movement to the left or right not in a gradual manner, and in infinite screw etc. embodiments by being a shifting component (23). In FIGS. 8*d* and 8*e*, an alternative embodiment is seen. In the figures, an alternative embodiment is seen, in which the guide arms (15.2) are separate from the bearing body (15.1). In this structure, at the parts where the guide arms (15.2) would be connected to the bearing body (15.1), screw paths/gears are formed. In this way, the shifting of the guide arms (15.2) on the bearing unit (15) by being moved back and forth via the geared form and their re-positioning and profitable usage of the apron (17) by making the guide arm (15.2) and apron (17) left-right movement is provided. In this context, all the structures comprising the shifting of the apron (17) with the guide arm (15.2) on which it is carried are within the context of this invention, and thus, they would not comprise novelty.

As a result of all of these improvements, the expected grinding or renewal life of the Top rollers (9) in the prior art are far exceeded and thus the known status of the art is exceeded. In this way the inventive step criterion is exceeded.

The above provided improvement is not only used in ring spinning systems, but also it can be used in all other yarn production techniques. Therefore, the invention cannot be limited to the representative applications given in this section. In the light of the basic elements and methods stated in the claims, any alternative embodiment which can be developed by the people skilled in the related art would mean violation of the invention.

I claim:

1. A fiber drafting mechanism comprising:

a front roller;

a top roller positioned against said front roller;

a pressure arm arranged so as to push said top roller toward said front roller;

a bearing unit;

a plurality of guide arms located on said bearing unit; and an apron positioned around said top roller and said plurality of guide arms so as to encircle said top roller and said plurality of guide arms, said apron and said front roller having a distance therebetween that is less than a distance between said top roller and said front roller, said apron shiftable on said top roller horizontally, said apron stretchable over said top roller and said plurality of guide arms by a tension component.

2. The fiber drafting mechanism of claim 1, said bearing unit having a bearing body and a bar, said bar shifting said bearing body and said plurality of guide arms so as to carry said apron horizontally.

3. The fiber drafting mechanism of claim 2, said plurality of guide arms comprising a plurality of grade cavities and a positioning housing formed on said bearing body.

4. The fiber drafting mechanism of claim 1, said plurality of guide arms each comprising at least one roller bearing that bears upon said apron.

5. The fiber drafting mechanism of claim 1, further comprising:

a limiter positioned so as to prevent said apron from shifting.

6. The fiber drafting mechanism of claim 2, further comprising:

an adjustment component fixed on said pressure arm so as to adjust the distance between said bearing body and said pressure arm, said adjustment component being rotatable.

7. The fiber drafting mechanism of claim 2, said bearing unit further comprising:

at least one pin positioned on said pressure arm; and at least one retaining ring cooperative with the pin so as to bear the pin on said bearing body so as to adjust pressure distribution of said top roller.

8. The fiber drafting mechanism of claim 2, said bearing unit further comprising:

a tension component which is fixed at an upper surface of said pressure arm and said bearing body so as to provide tension to said apron continuously and to allow said plurality of guide arms to be shifted in a horizontal plane.

9. The fiber drafting mechanism of claim 1, said apron being formed of rubber or a rubber-derivative material.

10. The fiber drafting mechanism of claim 1, further comprising:

a plurality of clearer roller positioned below each of said plurality of pressure arms in order to collect the fibers, each of the plurality of clearer rollers having a cylindrical shape; and a plurality of clearer roller bearing components carrying said plurality of clearer rollers.

11. A method comprising:

moving fibers over an apron;

passing the fibers over a plurality of top rollers and guide arms that are connected to a bearing body of a bearing unit that is placed on a pressure arm so as to cover the top rollers and the guide arms;

stretching the apron by application of tension via a tension component;

shifting the bearing unit that carries the apron at intervals in a horizontal plane as the fibers are moved, the steps of moving, passing, stretching and shifting occurring prior to twisting of yarns in compact yarn production.

12. The method of claim 11, the step of shifting comprising:

shifting the bearing unit via shift components.

13. The method of claim 11, the bearing body being fixed on the pressure arm such that the guide arms can be shifted on the bearing body.

14. The method of claim 13, the guide arms shifted independently on the bearing body.

15. The method of claim 11, a distance between a front roller and the apron being less than a distance between the top roller and the front roller.

16. The method of claim 11, further comprising:

increasing a length of the apron via bearing guide arms formed on the bearing body.

17. The method of claim 11, further comprising:

shifting the guide arms on the bearing body back-and-forth.

18. The method of claim 11, further comprising:

forming the apron of an elastic material; and coating the top rollers with the elastic material.

19. The method of claim 18, further comprising:

moving the apron to a left direction and a right direction.

* * * * *